US010718575B2

(12) United States Patent
Enright et al.

(10) Patent No.: US 10,718,575 B2
(45) Date of Patent: Jul. 21, 2020

(54) APPARATUS FOR COALESCENCE INDUCED DROPLET JUMPING

(71) Applicant: Nokia Technologies Oy, Espoo (FI)

(72) Inventors: Ryan Enright, Dublin (IE); Ross Lundy, Dublin (IE); Shenghui Lei, Dublin (IE); Shreyas Chavan, Urbana, IL (US)

(73) Assignee: Nokia Technolgies Oy, Espoo (FI)

( * ) Notice: Subject to any disclaimer, the term of this patent is extended or adjusted under 35 U.S.C. 154(b) by 186 days.

(21) Appl. No.: 15/851,406

(22) Filed: Dec. 21, 2017

(65) Prior Publication Data

US 2019/0195576 A1 Jun. 27, 2019

(51) Int. Cl.
*F28F 13/18* (2006.01)
*F28F 21/08* (2006.01)

(52) U.S. Cl.
CPC ..... *F28F 13/187* (2013.01); *F28F 21/084* (2013.01); *F28F 21/085* (2013.01); *F28F 2245/04* (2013.01); *F28F 2255/20* (2013.01)

(58) Field of Classification Search
CPC .. F28F 13/187; F28F 2245/04; F28F 2255/20; F28F 2260/00; F28F 21/084; F28F 21/085
See application file for complete search history.

(56) References Cited

U.S. PATENT DOCUMENTS 9,689,631 B2 6/2017 Xiao et al.
2004/0200442 A1 10/2004 Garner et al.
2010/0028604 A1* 2/2010 Bhushan ..... B05D 1/60 428/156
2011/0198059 A1* 8/2011 Gavillet ..... F28D 15/046 165/104.26
2011/0229667 A1* 9/2011 Jin ..... B81C 1/00206 428/34.1
2013/0244001 A1 9/2013 Wang et al.
2014/0017456 A1* 1/2014 Xiao ..... B08B 17/065 428/195.1
2014/0238645 A1* 8/2014 Enright ..... F28D 15/02 165/104.21
2014/0238646 A1* 8/2014 Enright ..... F28F 13/187 165/104.21
2014/0287150 A1* 9/2014 Miljkovic ..... B01D 5/0042 427/458

(Continued)

FOREIGN PATENT DOCUMENTS

WO 2013/184559 A1 12/2013
WO 2014/128556 A1 8/2014
WO 2017/163127 A1 9/2017

OTHER PUBLICATIONS

Enright et al., "Condensation on Superhydrophobic Surfaces: The Role of Local Energy Barriers and Structure Length Scale", Langmuir, Aug. 29, 2012, pp. 14424-14432.

(Continued)

*Primary Examiner* — Tho V Duong
(74) *Attorney, Agent, or Firm* — Harrington & Smith

(57) ABSTRACT

An apparatus and heat transfer system, the apparatus comprising: a substrate; a plurality of nucleation sites provided on the substrate; a nanostructured surface surrounding the nucleation sites arranged to enable coalescence induced droplet jumping; wherein both the plurality of nucleation sites and the nanostructured surface are hydrophobic.

20 Claims, 6 Drawing Sheets

(56) References Cited

U.S. PATENT DOCUMENTS

| | | | | |
|---|---|---|---|---|
| 2017/0010060 | A1 | 1/2017 | Chang et al. | |
| 2017/0176114 | A1 | 6/2017 | Kandlikar et al. | |
| 2017/0176115 | A1* | 6/2017 | Zhang ..... | F28F 13/187 |

OTHER PUBLICATIONS

Chen et al., "Coalescence-Induced Jumping of Multiple Condensate Droplets on Hierarchical Superhydrophobic Surfaces", Scientific Report, Jan. 4, 2016, pp. 1-11.
Miljkovic et al., "Jumping-Droplet Electrostatic Energy Harvesting", Applied Physics Letters, vol. 105, Jul. 2014, 32 pages.
Enright et al., "How Coalescing Droplets Jump", ACS Nano, Aug. 29, 2014, 11 pages.
Hou et al., "Recurrent Filmwise and Dropwise Condensation on a Beetle Mimetic Surface", ACS Nano, Dec. 7, 2014, 11 pages.
Yao et al., "Wetting Behavior on Hybrid Surfaces with Hydrophobic and Hydrophilic Properties", Applied Surface Science, vol. 290, Jan. 30, 2014, pp. 59-65.
International Search Report and Written Opinion received for corresponding Patent Cooperation Treaty Application No. PCT/FI2018/050931, dated Mar. 13, 2019, 13 pages.

* cited by examiner n = 3 n = 6 n = 10

APPARATUS FOR COALESCENCE INDUCED DROPLET JUMPING

TECHNOLOGICAL FIELD

Examples of the disclosure relate to an apparatus for coalescence induced droplet jumping. For example, they relate to apparatus for coalescence induced droplet jumping to provide heat transfer.

BACKGROUND

Vapour condensation can be used for heat transfer in a wide range of applications such as thermoelectric power generation, thermal desalination and other suitable applications. Vapour condensing on surfaces forms a liquid film or distinct droplets. Increasing the efficiency with which the liquid film or droplets can be removed from the surfaces will improve the heat transfer.

BRIEF SUMMARY

According to various, but not necessarily all, examples of the disclosure there is provided an apparatus comprising: a substrate; a plurality of nucleation sites provided on the substrate; a nanostructured surface surrounding the nucleation sites arranged to enable coalescence induced droplet jumping;

wherein both the plurality of nucleation sites and the nanostructured surface are hydrophobic.

The nanostructured surface may be arranged so that the spacing between nucleation sites enables coalescence induced droplet jumping.

The plurality of nucleation sites may be arranged in clusters such that each nucleation site within a cluster is equally spaced from a central point of the cluster.

The plurality of nucleation sites may be arranged in clusters comprising a plurality of sub-groups wherein each sub-group comprises a plurality of nucleation sites located on the circumference of a circle and the circles corresponding to the different sub-groups are concentric.

The ratio of the distance from the centre of a nucleation site to a centre of the cluster and the diameter of the nucleation sites may be between two and three.

Each cluster of nucleation sites may comprise more than two nucleation sites.

The plurality of nucleation sites within a cluster may be arranged in a symmetrical pattern.

The plurality of nucleation sites within a cluster may be arranged in a hexagon.

The apparatus may comprise a hydrophobic coating provided on both the plurality of nucleation sites and the nanostructured surface. The hydrophobic coating may comprise a polymer.

The nanostructured surface may comprise nanostructures arranged to extend perpendicularly from the substrate.

The nanostructured surface may comprise nanostructures having a high aspect ratio.

The nucleation sites may be smooth.

The nucleation sites may have a higher surface energy than the nanostructured surface.

The nucleation sites may have a higher thermal conductivity than the nanostructured surface.

The nucleation sites and the nanostructured surface may be formed from the same material.

Each nucleation site may have a diameter in the range of 1 to 100 nanometers.

According to various, but not necessarily all, examples of the disclosure there is provided a heat transfer system comprising an apparatus as described above.

The apparatus may provide a condenser in the heat transfer system.

The apparatus may provide an evaporator in the heat transfer system.

According to various, but not necessarily all, examples of the disclosure there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Examples of the disclosure relate to an apparatus 1 and system 21 for heat transfer. The apparatus 1 comprises a surface 9 on which droplets can condense. The surface 9 is structured so as to enhance the coalescence of nano-sized droplets to provide for more efficient transfer between surface energy of the droplets and kinetic energy of the droplets. This facilitates droplet jumping and improves the heat transfer of the apparatus 1.

Figure 1:
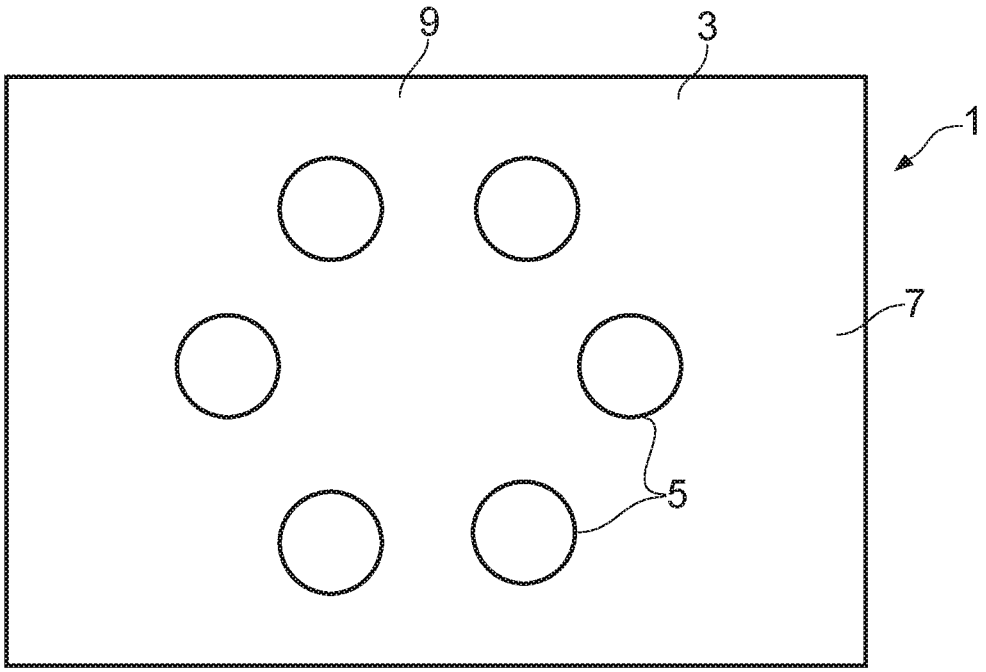
FIG. 1 illustrates an apparatus.

FIG. 1 schematically illustrates a plan view of an apparatus 1 according to examples of the disclosure. The apparatus 1 comprises a substrate 3, a plurality of nucleation sites 5 and a nanostructured surface 7. The apparatus 1 may be for heat transfer.

The substrate 3 may comprise a flat or substantially flat surface 9 for heat transfer. The substrate 3 may comprise a thermally conductive material. The thermally conductive material could comprise a metal such as aluminium, copper or any other suitable material.

The plurality of nucleation sites 5 are arranged on the surface 9 of the substrate 3. In some examples the nucleation sites 5 may be formed directly from the surface 9 of the substrate 3. In other examples one or layers could be provided over the surface 9 of the substrate 3. The one or more layers may provide improved thermal conductivity or wetting properties compared to the material used for the substrate 3.

The nucleation sites 5 may comprise sites on the surface 9 of the substrate 3 which are arranged to encourage formation of droplets. The nucleation sites 5 may be smooth so as to encourage the formation of droplets on the nucleation sites 5. The nucleation sites 5 may be smooth compared to the nanostructured surface 7. The nucleation sites 5 may be smooth in that the ratio of the total area of the nucleation sites 5 to the plan area of the nucleation sites 5 is small. In some examples the nucleation sites 5 may be smooth such that the surface of the nucleation sites 5 satisfies the condition $1>\cos \theta a>0.65$ where $\theta a$ is the intrinsic advancing contact angle of a droplet formed on the nucleation site 5.

In the example of FIG. 1 each of the nucleation sites 5 has the same size and shape. Each of the nucleation sites 5 has a circular shape in the example apparatus 1 of FIG. 1. It is to be appreciated that in other examples the nucleation sites 5 could have a different shape and that the nucleation sites 5 might not be the same size and shape.

In the example of FIG. 1 six nucleation sites 5 are shown. Other numbers of nucleation sites 5 may be provided in other examples of the disclosure. It is to be appreciated that the apparatus 1 shown in FIG. 1 may be a portion of an apparatus and that the pattern of the nucleation sites 5 may be repeated across the surface of the substrate 3 forming the apparatus 1. In the example of FIG. 1 the six nucleation sites are arranged in a hexagon. The hexagon is a regular hexagon. It is to be appreciated that other arrangements for the nucleation sites 5 could be used in other examples of the disclosure. Other example arrangements for the nucleation sites are shown in FIGS. 3 to 6B.

Each nucleation site 5 is provided separate to the other nucleation sites 5. None of the nucleation sites 5 contact any other nucleation sites 5. There is a gap provided between adjacent nucleation sites 5. The nanostructured surface 7 is provided in the gaps between the nucleation sites 5.

The nanostructured surface 7 is also provided on the surface of the substrate 3. In some examples the nanostructured surface 7 may be formed directly from the surface 9 of the substrate 3. In other examples one or more layers could be provided between the surface 9 of the substrate 3 and the nanostructured surface 7.

The nanostructured surface 7 is provided surrounding each of the nucleation sites 5 within the plurality of nucleation sites 5. The nanostructured surface 7 forms a perimeter for each of the nucleation sites 5 so that each nucleation site 5 is fully enclosed by the nanostructured surface 7.

In examples of the disclosure the nanostructured surface 7 surrounds each of the nucleation sites 5. Each of the nucleation sites 5 is therefore enclosed by a nanostructured surface 7.

The nanostructured surface 7 comprises nanostructures which extend perpendicularly, or substantially perpendicularly, from the surface 9 of the substrate 3. The nanostructures may have a high aspect ratio. The high aspect ratio could mean that the length of the nanostructures is at least several times longer than the width of the nanostructures. In some examples the high aspect ratio could mean that the length of the nanostructures is at least ten times longer than the width of the nanostructures. In some examples the high aspect ratio could mean that the length of the nanostructures is more than ten times longer than the width of the nanostructures In some examples of the disclosure the nanostructures that form the nanostructured surface 7 may comprise columnar structures. The columnar structures may be shaped so as to have the same width, or substantially the same width, along the length of the nanostructure. Other shaped nanostructures could be used in other examples of the disclosure. For example, the width of the nanostructure could reduce along the length of the nanostructure so as to form a conical shaped nanostructure. In some examples the nanostructure could comprise nanotubes, nanohorns or any other suitable nanostructures. The nanostructures could be single walled or multi walled structures.

In some examples each of the nanostructures within the nanostructured surface 7 may be the same size or substantially the same size. Each of the nanostructures within the nanostructured surface 7 might extend the same distance, or a similar distance from the surface 9 of the substrate 3. In other examples the nanostructures within the nanostructured surface 7 could be different sizes.

In some examples the nanostructures within the nanostructured surface 7 may be arranged within a regular array on the surface 9 of the substrate 3. In other examples the nanostructures could be arranged in an irregular array. The way in which the nanostructures are arranged may be determined by the methods used to fabricate the nanostructured surface 7.

The nanostructured surface 7 may comprise sites on the surface 9 of the substrate 3 which are arranged to discourage formation of droplets. The nanostructured surface 7 may provide a rough surface compared to the nucleation sites 5 so as to encourage the formation of droplets on the nucleation sites 5.

In examples of the disclosure both the plurality of nucleation sites 5 and the nanostructured surface 7 are hydrophobic. In some examples the same material may be used for both the plurality of nucleation sites 5 and the nanostructured surface 7 so that the plurality of nucleation sites 5 and the nanostructured surface 7 are equally hydrophobic.

In some examples a hydrophobic coating may be provided on both the plurality of nucleation sites 5 and the nanostructured surface 7. The hydrophobic coating could be provided overlaying the surface of the substrate 3. The hydrophobic coating could comprise a polymer such as polytetrafluoroethylene or any other suitable hydrophobic material.

In some examples of the disclosure the nucleation sites 5 and the nanostructured surface 7 may be formed from the same material. In such examples the nucleation sites 5 and the nanostructured surface 7 may have the same chemical properties but would have different physical properties due to their different surface structures. For example, the nanostructures of the nanostructured surface 7 may decrease the thermal conductivity of the nanostructured surface 7 compared to the nucleation sites 5.

In some examples the nucleation sites 5 and the nanostructured surface 7 may be made of different materials. In such examples the nucleation sites 5 and the nanostructured surface 7 may have different properties. For example the plurality of nucleation sites 5 may have a higher surface energy than the nanostructured surface 7.

In some examples the nucleation sites 5 have a higher thermal conductivity than the nanostructured surface 7. This may encourage droplets to form at the nucleation sites 5 rather than on the nanostructured surface 7. The difference in the thermal conductivity could be achieved through the use of different materials. For example, the nucleation sites 5 could be formed from a metallic material such as copper or aluminium while the nanostructured surface 7 could be formed from an insulating material such as an oxide, an inorganic oxide, a silicon oxide an organic polymer or any other suitable material. In some examples the difference in thermal conductivity could be achieved through the different structures of the nucleation sites 5 and the nanostructured surface 7. For example, the nanostructures with a high aspect ratio are more thermally insulating than the smooth surfaces of the nucleation sites 5.

The smooth nucleation sites 5 have a high surface energy which promotes droplet growth on the nucleation sites 5. The high surface energy provides for a lower contact angle as the droplet forms on the nucleation sites 5. The nanostructured surface 7 has a low surface energy which discourages droplet growth on the nanostructured surface 7. The low surface energy provides for a high contact angle as a droplet comes into contact with the nanostructured surface 7. This means that the droplets formed on the surface of the substrate 3 mainly form on the plurality of nucleation sites 5. In some examples all of the droplets might form on the plurality of nucleation sites 5 and none of the droplets might form on the nanostructured surface 7. In other examples a small amount of droplets might form on the nanostructured surface 7.

When the apparatus 1 is in use, droplets will form on the plurality of nucleation sites 5. As the droplet grows on a nucleation site 5 it will eventually reach a size where it contacts the nanostructured surface 7 surrounding the nucleation site 5. As the nanostructured surface 7 has a lower surface energy than the nucleation site 5 this forces the droplet into a Cassie state. The Cassie state is a state in which the droplet rests on the tips of the nanostructured surface 7 so that most of the droplet is in contact with the nucleation sites 5 and not the nanostructured surface 7. When the droplet grows large enough it will contact other droplets formed on adjacent nucleation sites. This will cause the droplets to coalesce.

When the droplets coalesce this reduces the total surface energy of the droplets. The surface energy is, at least partially converted to kinetic energy, which causes the coalesced droplet to jump off the surface 9 of the substrate 3. This droplet jumping enables the droplets to be removed from the substrate 3 and provides for efficient heat transfer.

In examples of the disclosure both the nucleation sites 5 and the nanostructured surface 7 are hydrophobic. This increases the efficiency of the jumping of the droplets as it prevents the droplets from sticking to the nucleation sites 5. The sizes, separations and geometries of the plurality of nucleation sites 5 may be arranged to increase the efficiency of the conversion of surface energy of the droplets to kinetic energy of the droplets. FIGS. 3 to 6B illustrate example arrangements for the plurality of nucleation sites 5.

Figure 2:
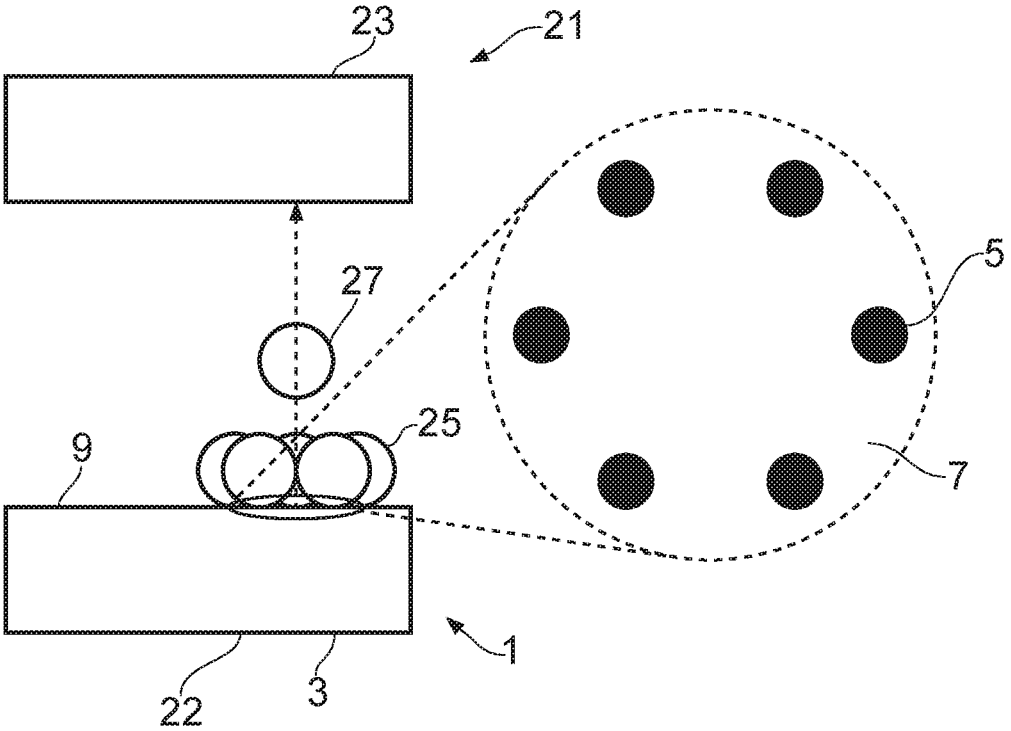
FIG. 2 illustrates a heat transfer system comprising an apparatus.

FIG. 2 schematically illustrates a cross section of a heat transfer system 21 comprising an example apparatus 1. In the example of FIG. 2 the heat transfer system 21 comprises a vapour chamber. The apparatus 1 provides the condenser 22 of the vapour chamber and an evaporator 23 is positioned overlaying and spaced from the apparatus 1. It is to be appreciated that apparatus 1 according to examples of the disclosure could be used in other types of heat transfer systems 21. For example the apparatus 1 could be used in heat pipes, a two phase forced convection system or any other suitable type of system. In some examples the apparatus 1 could be provided within the evaporator 23 as instead of, or in addition to, the condenser 22.

In the example heat transfer system 21 of FIG. 2 the plurality of nucleation sites 5 are arranged on the surface 9 of the substrate 3. A plurality of droplets 25 have formed at each of the nucleation sites 5. In the example heat transfer system 21 of FIG. 2 the plurality of nucleation sites 5 comprises six nucleation sites 5 arranged in a hexagonal shape. A droplet 25 has formed at each of the nucleation sites 5.

When each droplet 25 grows large enough it will contact the droplets formed at neighboring nucleation sites 5. This will enable the droplets formed at neighboring nucleation sites 5 to coalesce into a single larger droplet. In the example of FIG. 2 six droplets formed at the six different nucleation sites 5 combine to form one single larger droplet.

The single larger droplet 27 has a lower surface energy than the individual smaller droplets 25. The surface energy is converted into kinetic energy which causes the single larger droplet 27 to jump. The jumping of the larger droplet 27 comprises motion of the droplet 27 in a direction which is perpendicular, or substantially perpendicular, to the surface 9 of the substrate 3.

If the larger droplet 27 has sufficient kinetic energy then the larger droplet 27 will jump far enough away from the surface 9 of the substrate 3 to enable the larger droplet 27 to be removed from the heat transfer system 21. In order to be removed from the heat transfer system 21 the larger droplet 27 may need to jump out of the boundary layer of the apparatus 1.

The geometric arrangement of the plurality of nucleation sites 5 may be arranged to increase the efficiency of the transfer between the surface energy of the individual droplets 25 and the kinetic energy of the larger droplet 27. The efficiency of this transfer could be increased by using nucleation sites 5 having particular diameters, by having a particular spacing between nucleation sites 5 and/or by arranging the nucleation sites 5 into particular patterns.

Figure 3:
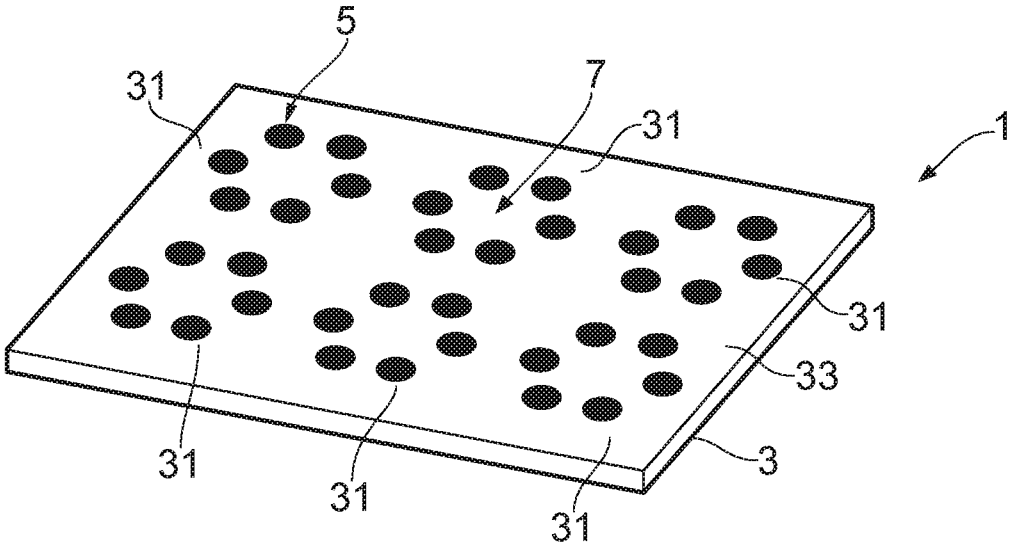
FIG. 3 illustrates an example arrangement for nucleation sites.

FIG. 3 illustrates an example arrangement for the plurality of nucleation sites 5 that could be used arranged to increase the efficiency of the transfer between the surface energy of the individual droplets 25 and the kinetic energy of the larger droplet 27 in some examples of the disclosure.

In the example of FIG. 3 the plurality of nucleation sites 5 are arranged in clusters 31. Each cluster 31 comprises a plurality of nucleation sites 5 which are positioned close to each other. The spacing between nucleation sites 5 within the same cluster 31 may be less than the spacing between nucleation sites 5 of different clusters 31. This ensures that when the individual droplets 25 combine to form the single larger droplet 27, the larger droplet 27 is formed from nucleation sites 5 in the same cluster 31 rather than nucleation sites 5 in neighboring clusters 31.

In the example of FIG. 3 each of the clusters 31 comprise the same number of nucleation sites 5. Each cluster of nucleation sites 5 comprises more than two nucleation sites 5. In the example of FIG. 3 each of the clusters 31 comprises six nucleation sites 5. Other numbers of nucleation sites 5 could be used in other examples of the disclosure. In some examples the clusters 31 could be arranged so that different clusters 31 within the same apparatus 1 comprise different numbers of nucleation sites 5.

The plurality of nucleation sites 5 may be arranged within the cluster 31 such that each nucleation site 5 within a cluster 31 is equally spaced from a central point of the cluster 31. The relative spacing between the nucleation sites 5 may be selected so as to facilitate the coalescence of a plurality of individual droplets 25 formed at the nucleation sites 5 into a single larger droplet 27. This relative spacing is given by the ratio $L/D_b$ where L is the distance from the centre of a nucleation site 5 to the centre of the cluster 31 and $D_b$ is the diameter of a nucleation site 5. In some examples L could be several times larger than $D_b$. In some examples L could be two to three times larger than $D_b$. In some example L could be up to eight times larger than $D_b$.

The distance from the centre of a nucleation site 5 to the centre of the cluster 31 may be large enough to enable a coalesced droplet 27 to be large enough to jump but small enough to prevent the coalesced droplet 27 from being too large for jumping. In some examples the diameter of the nucleation sites 5 could be in the range of 1 to 100 nanometers and the distance L from the centre of a nucleation site 5 to the centre of the cluster 31 could be between two to three times the diameter $D_b$ of the nucleation sites 5. This may enable nano-sized individual droplets 25 to coalesce to form a larger droplet 27.

The plurality of nucleation sites 5 within a cluster 31 may be arranged in a symmetrical pattern. The symmetrical pattern may enable a larger droplet 27 to be formed from individual droplets 25 formed at each of the nucleation sites 5. In the example of FIG. 3 the symmetrical shape comprise a hexagon. The hexagon has multiple orders of both rotational and mirror symmetry. Other shapes could be used in other examples of the disclosure.

The clusters 31 of nucleation sites 5 are arranged into a linear array 33 in the example of FIG. 3. The linear array 33 comprises a plurality of rows and columns where the columns extend perpendicularly to the rows. The linear array 33 may also be symmetrical. In the example of FIG. 3 the linear array 33 comprises two rows and three columns. It is to be appreciated that the linear array 33 could comprise any number of rows and columns in other examples. In other examples the clusters 31 of the nucleation sites 5 could be arranged into a different pattern. The different pattern does not need to be regular, repeating or symmetrical.

Figure 4A:
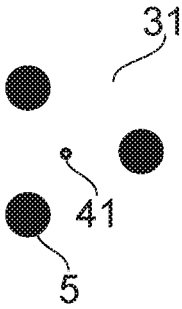
FIGS. 4A to 4C illustrate example arrangements for nucleation sites.
Figure 4B:
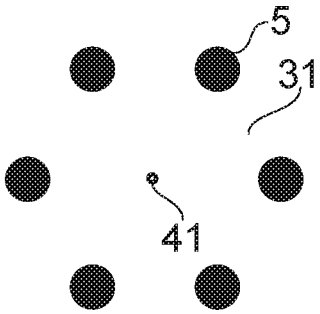
Figure 4C:
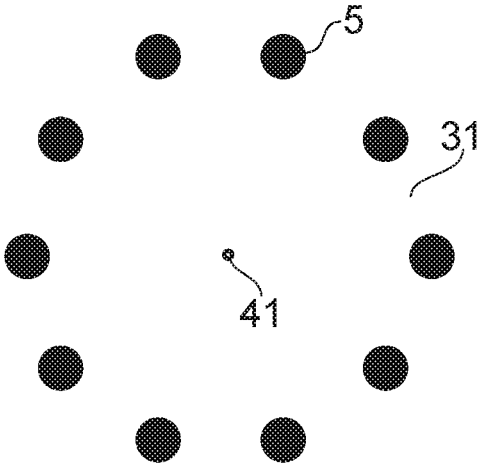

FIGS. 4A to 4C illustrate example arrangements for clusters 31 of the nucleation sites 5 which could be used in some examples of the disclosure. Each of the clusters 31 comprises more than two nucleation sites 5.

In the example of FIG. 4A the cluster 31 comprises three nucleation sites 5. The nucleation sites 5 are arranged in a triangle with a nucleation site 5 on each corner of the triangle. The triangle is an equilateral triangle so that each corner is an equal distance from a centre point 41. As the triangle is an equilateral triangle this also means that the distance between adjacent nucleation sites 5 is the same for each of the nucleation sites 5 within the cluster 31.

The example arrangement for the cluster 31 shown in FIG. 4A may enable three individual droplets 25 formed on the three different nucleation sites 5 to coalesce into a single larger droplet 27. This may provide for a more efficient transfer of energy from the surface energy of the smaller droplets 25 to the kinetic energy of the large combined droplet 27. This energy transfer may be more efficient compared to the coalescence of just two droplets.

In the example of FIG. 4B the cluster 31 comprises six nucleation sites 5. The nucleation sites 5 are arranged in a hexagon with a nucleation site 5 on each corner of the hexagon. The hexagon is a regular hexagon so that each corner is an equal distance from a centre point 41. As the hexagon is a regular hexagon this also means that the distance between adjacent nucleation sites 5 is the same for each of the nucleation sites 5 within the cluster 31.

The example arrangement for the cluster 31 shown in FIG. 4B may enable six individual droplets 25 formed on the six different nucleation sites 5 to coalesce into a single larger droplet 27. This may provide for a more efficient transfer of energy from the surface energy of the smaller individual droplets 25 to the kinetic energy of the large combined droplet 27. This energy transfer may be more efficient compared to the coalescence of just two droplets and/or compared to the coalescence of just three droplets 25 that can be achieved with the arrangement shown in FIG. 4A.

In the example of FIG. 4C the cluster 31 comprises ten nucleation sites 5. The nucleation sites 5 are arranged in a decagon with a nucleation site 5 on each corner of the decagon. The decagon is a regular decagon so that each corner is an equal distance from a centre point 41. As the decagon is a regular decagon this also means that the distance between adjacent nucleation sites 5 is the same for each of the nucleation sites 5 within the cluster 31.

The example arrangement for the cluster 31 shown in FIG. 4C may enable ten individual droplets 25 formed on the ten different nucleation sites 5 to coalesce into a single larger droplet 27. This may provide for a more efficient transfer of energy from the surface energy of the smaller individual droplets 25 to the kinetic energy of the large combined droplet 27. This energy transfer may be more efficient compared to the coalescence of just two droplets and/or compared to the coalescence of three or six droplets 25 that can be achieved with the arrangements shown in FIGS. 4A and 4B.

Figure 5A:
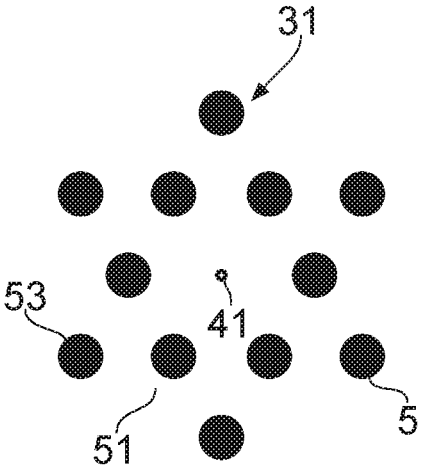
FIGS. 5A to 5B illustrate example arrangements for nucleation sites.
Figure 5B:
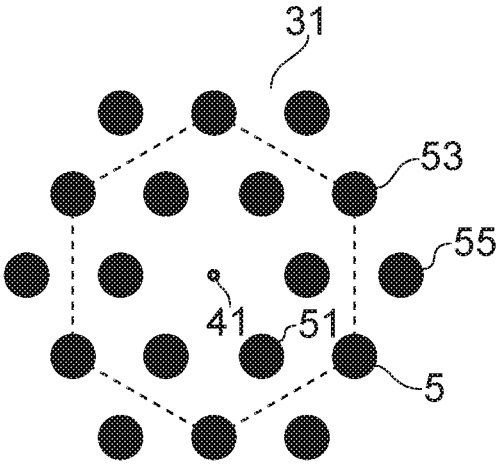

FIGS. 5A and 5B illustrate alternative example arrangements for clusters 31 of nucleation sites 5.

In the example of FIG. 5A the cluster 31 comprises two sub-groups 51, 53 of nucleation sites 5. The first sub-group 51 of nucleation sites 5 are arranged so that each nucleation site 5 within the first sub-group 51 is equally spaced at a first distance from a central point 41 of the cluster 31. The second sub-group 53 of nucleation sites 5 are arranged so that each nucleation site 5 within the second sub-group 53 is equally spaced at a second distance from a central point 41 of the cluster 31. The first distance is smaller than the second distance. This provides a first sub-group 51 of nucleation sites 5 located on the circumference of a first circle, and a second sub-group 53 of nucleation sites 5 located on the circumference of a second, concentric circle.

In the example of FIG. 5B the cluster 31 comprises three sub-groups 51, 53, 55 of nucleation sites 5. The first sub-group 51 of nucleation sites 5 are arranged so that each nucleation site 5 within the first sub-group 51 is equally spaced at a first distance from a central point 41 of the cluster 31. The second sub-group 53 of nucleation sites 5 are arranged so that each nucleation site 5 within the second sub-group 53 is equally spaced at a second distance from a central point 41 of the cluster 31. A dashed line is shown on FIG. 5B to indicate the second sub-group 53. The third sub-group 55 of nucleation sites 5 are arranged so that each nucleation site 5 within the third sub-group 55 is equally spaced at a third distance from a central point 41 of the cluster 31. The first distance is smaller than the second distance and the second distance is smaller than the third distance. This provides a first sub-group 51 of nucleation sites 5 located on the circumference of a first circle, a second sub-group 53 of nucleation sites 5 located on the circumference of a second, concentric circle and a third sub-group 55 of nucleation sites 5 located on the circumference of a third, concentric circle.

In the examples of FIGS. 5A and 5B six nucleation sites 5 are provided in each sub-group 51, 53, 55. In other examples different numbers of nucleation sites 5 could be provided. In some examples different sub-groups within the same cluster 31 may comprise different numbers of nucleation sites 5.

In the examples of FIGS. 5A and 5B each of the nucleation sites 5 have the same diameter so that even nucleation sites 5 within different sub-groups 51, 53, 55 have the same diameter. In other examples some of the nucleation sites 5 within a cluster 31 could have different diameters. For example, nucleation sites 5 within different sub-groups 51, 53, 55 could have different diameters.

Figure 6A:
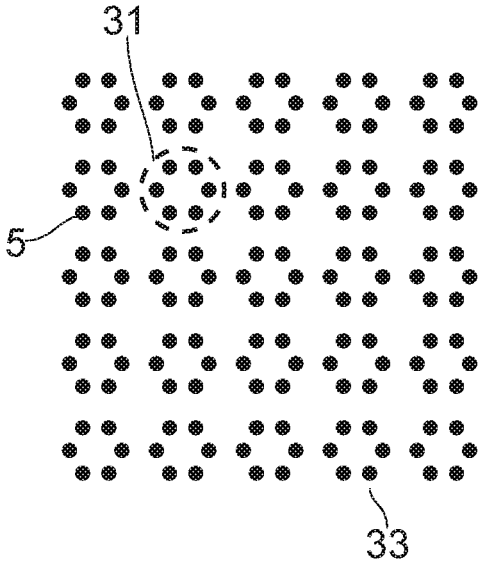
FIGS. 6A to 6B illustrate example arrangements for nucleation sites.
Figure 6B:
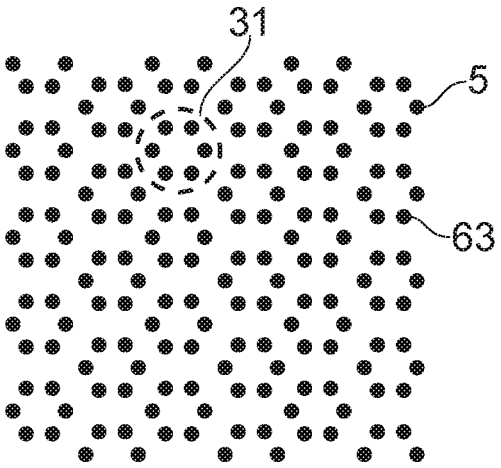

FIGS. 6A to 6B illustrate example arrangements for clusters 31 of the nucleation sites 5 that could be used in some examples of the disclosure. The arrangements could be provided on the surface 9 of the substrate 3.

In the example of FIG. 6A each cluster 31 of nucleation sites 5 comprises six nucleation sites 5 arranged in a regular hexagon. The plurality of clusters 31 are arranged into a linear array 33. The linear array 33 comprises a plurality of rows and columns where the columns extend perpendicularly to the rows. In the example of FIG. 6A the linear array 33 comprises five rows and five columns. It is to be appreciated that the linear array 33 could comprise any number of rows and columns in other examples.

In the example of FIG. 6B each cluster 31 of nucleation sites 5 also comprises six nucleation sites 5 arranged in a regular hexagon. The plurality of clusters 31 are arranged into a hexagonal array 63. In the hexagonal array 63 the clusters 31 are arranged in a hexagonal close packing arrangement. This may provide for a denser packing of nucleation sites 5 compared to the linear 33 as used in FIG. 6B.

It is to be appreciated that in other examples the clusters 31 of the nucleation sites 5 could be arranged into a different pattern. The different pattern does not need to be regular, repeating or symmetrical.

Figure 7A:
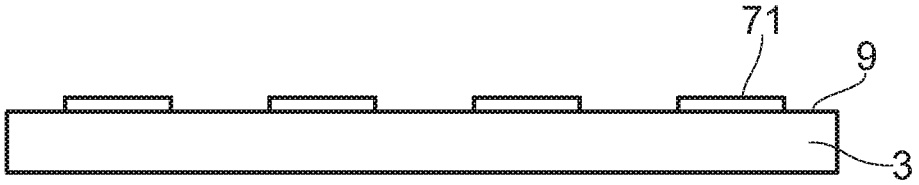
FIGS. 7A to 7C illustrate a method of fabricating an apparatus.
Figure 7B:
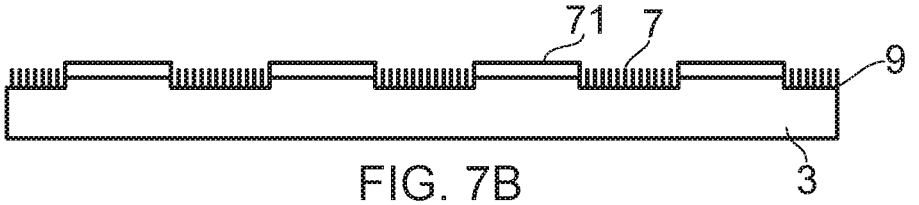
Figure 7C:
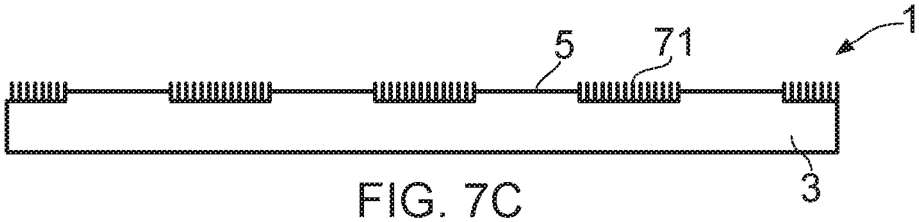

FIGS. 7A to 7C illustrate a method of fabricating an apparatus 1 according to examples of the disclosure.

In the block of the method shown in FIG. 7A the substrate 3 of the apparatus 1 is provided. The substrate 3 comprises a planar or substantially planar surface 9. In the block of the method shown in FIG. 7A the pattern of the plurality of nucleation sites 5 is formed on the surface of the substrate 3. In the example of FIG. 7A the pattern is formed by depositing a mask 71 on the surface 9 of the substrate 3. The mask 71 is deposited in the areas where the plurality of nucleation sites 5 are to be formed leaving the areas that are to form the nanostructured surface 7 exposed.

The mask 71 may be deposited using lithographic techniques or any other suitable method. The mask 71 may comprise any suitable material. In some examples the mask 71 may be formed from a resin, a thin layer of metal, a thin layer of metal oxide or any other suitable material. Other methods of forming the pattern could be used in other examples of the disclosure.

In the block of the method shown in FIG. 7B the nanostructured surface 7 is formed on the exposed areas of the surface 9 of the substrate 3. The nanostructured surface 7 could be formed by using vapour deposition or any other suitable method. In some examples the nanostructures which form the nanostructured surface 7 could be grown directly on the surface 9 on the substrate 3. This may enable the nanostructures to comprise a plurality of columnar structures which extend perpendicularly, or substantially perpendicularly, from the surface 9 of the substrate 3. In other examples the nanostructures could be formed on a different substrate and then deposited on the surface 9 of the substrate 3 within the apparatus 1.

The methods used to form the nanostructured surface 7 may depend on the materials used for the nanostructures, the material used for the substrate 3 and any other suitable factors.

In the block of the method shown in FIG. 7C the mask 71 is removed from the substrate 3. This leaves the smooth nucleation sites 5 surrounded by the rough nanostructured surface 7.

In examples of the disclosure both the plurality of nucleation sites 5 and the nanostructured surface 7 are hydrophobic. In some examples both the plurality of nucleation sites 5 and the nanostructured surface 7 could be formed from the same material which may be a hydrophobic material. In other examples a hydrophobic coating could be provided over both the plurality of nucleation sites 5 and the nanostructured surface 7. The hydrophobic coating could comprise a polymer such as polytetrafluoroethylene or any other suitable hydrophobic material.

It is to be appreciated that other methods for forming the apparatus 1 could be used in other examples of the disclosure. For instance in cases where the mask 71 is formed of thin metal or metal oxide the mask 71 does not need to be removed from the surface 9 of the substrate 3. Instead the mask 71 could form the plurality of smooth nucleation sites 5.

Figure 8:
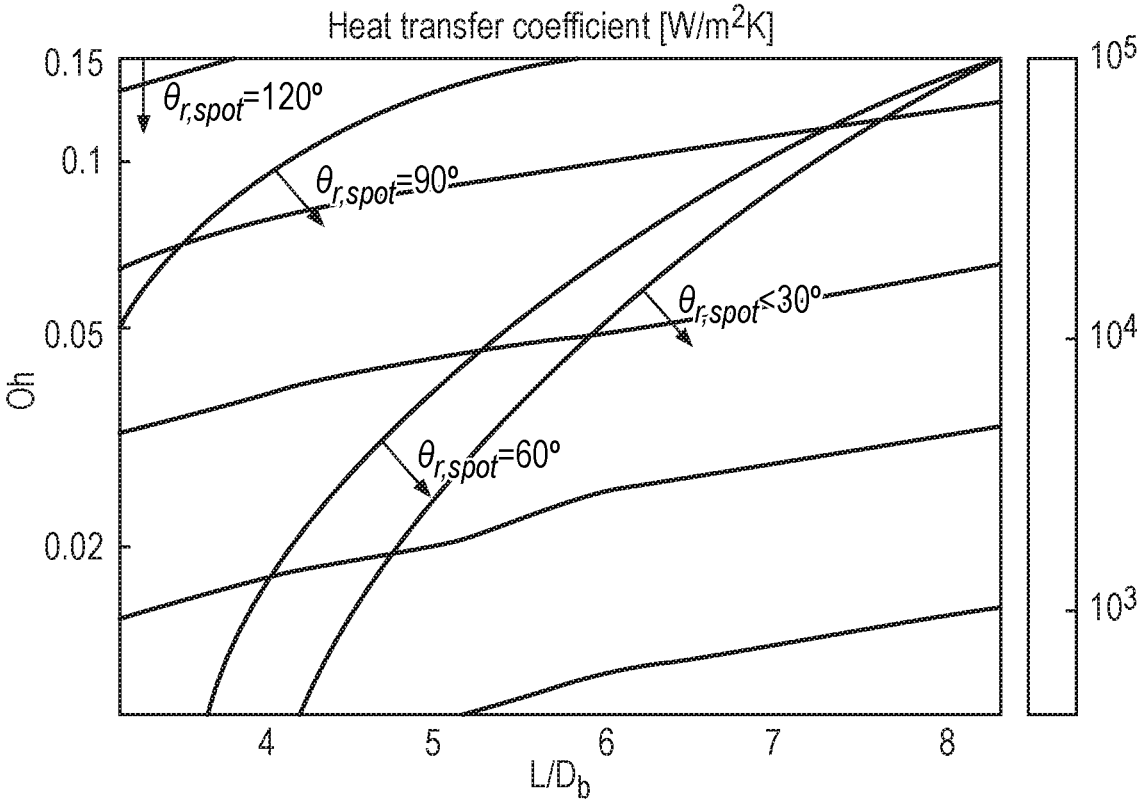
FIG. 8 illustrates a plot showing the efficiency of heat transfer for droplets having different contact angles.

FIG. 8 illustrates a plot showing the efficiency of heat transfer for droplets 25 having different contact angles. The results shown in FIG. 8 were obtained using a numerical simulation. The results shown in FIG. 8 were obtained for a binary system of nucleation sites 5. That is, for nucleation sites 5 arranged in pairs so that two individual droplets 25 coalesce to form a single large droplet 27.

The x axis represents the relative spacing between the nucleation sites 5. This is given by the ratio $L/D_b$ where L is the distance from the centre of a nucleation site 5 to the centre of the pair and $D_b$ is the diameter of a nucleation site 5. The left hand y axis represents the Ohnesorge number and the right hand y axis represents the heat transfer coefficient. The different plots show the different contact angles $\theta_{r,\ spot}$ of the droplets on the surface of the substrate 3.

The results shown in FIG. 8 show that the heat transfer is more efficient for droplets having higher contact angles. This corresponds to the top left hand corner of the plot. In examples of the disclosure the plurality of nucleation sites 5 may be arranged in clusters 31 so as to create the conditions shown in the top left hand corner of the plot of FIG. 8.

Figure 9:
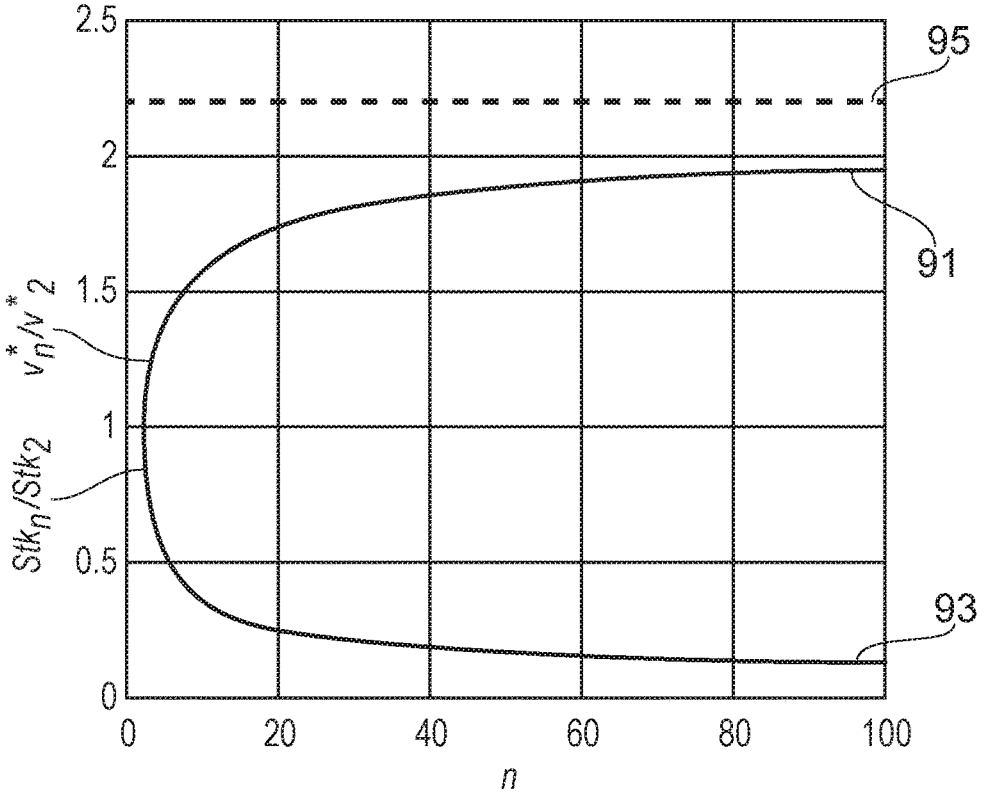
FIG. 9 illustrates a plot showing the efficiency of heat transfer for the coalescence of different numbers of droplets.

FIG. 9 illustrates a plot showing the efficiency of heat transfer for the coalescence of different numbers of droplets 25. The results shown in FIG. 9 were obtained using a numerical simulation.

The x axis of the plot represents n which is the number of droplets. The upper trace 91 represents the ratio of the velocities of a coalesced droplet 27 formed from n individual droplets 25 compared to a coalesced droplet 27 formed from two individual droplets 25. This shows that as the number of droplets n increases the total energy available for transfer from surface energy into kinetic energy increases and so the velocity of the coalesced droplets 27 increases. This shows that improved energy transfer can be achieved by having a larger number of small droplets 25 coalesce into an single larger droplet 27 than by having lots of pairs of droplets 25 coalesce into medium sized droplets. The dashed line 95 shows the asymptotic limit which represents the maximum ratio of the velocities.

The lower trace 93 represents the ratio of the Stokes number for a coalesced droplet formed from n individual droplets 25 compared to a coalesced droplet 27 formed from two droplets. This shows that as the number of droplets n increases the relative Stokes number decreases.

The plots shown in FIG. 9 show that the biggest gains are obtained for clusters 31 of nucleation sites 5 having up to twenty nucleation sites 5. Therefore in examples of the disclosure the nucleation sites 5 could be arranged in clusters 31 having up to twenty nucleation sites 5. In some examples the nucleation sites 5 could be arranged in clusters 31 having more than twenty nucleation sites 5. In such examples this may still provide an improved performance compared to apparatus 1 where the nucleation sites 5 are arranged in pairs.

This shows that it is more efficient to have more than two droplets 25 coalesce than have just two droplets coalesce. Therefore in order to provide a more efficient heat transfer system the clusters 31 of nucleation sites 5 may each comprise more than two nucleation sites 5 in examples of the disclosure.

Figure 10:
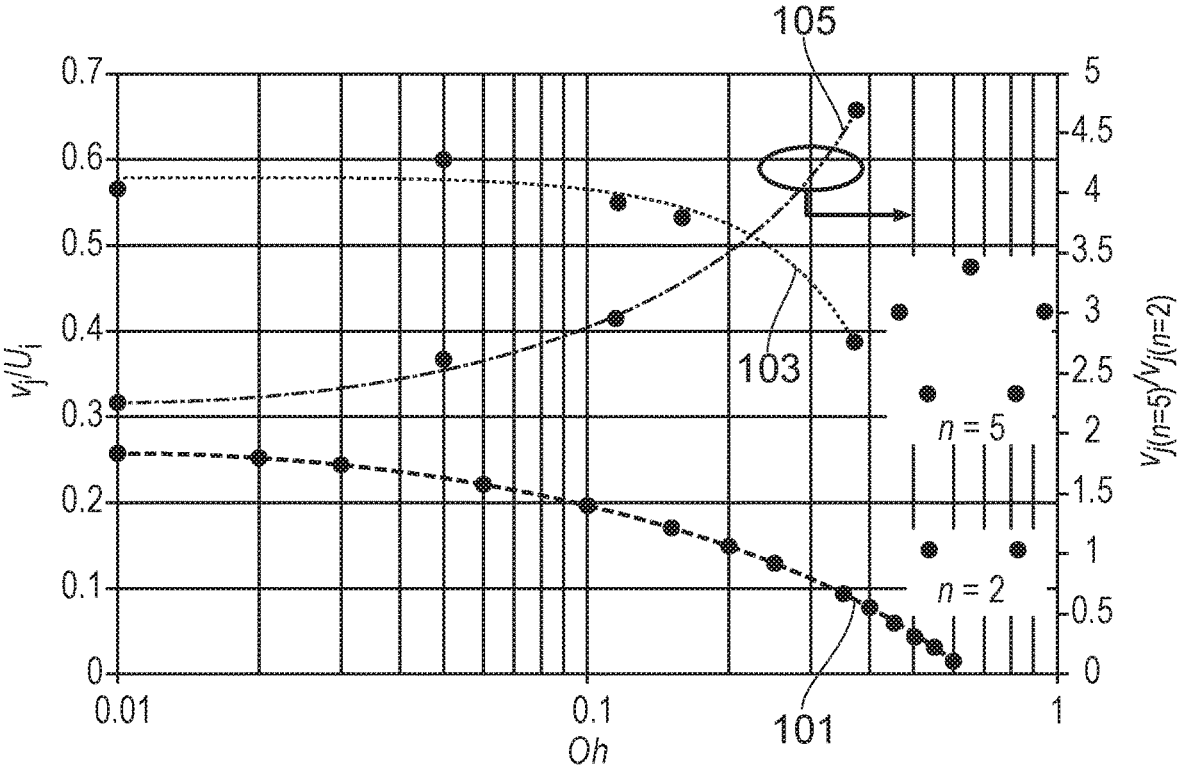
FIG. 10 illustrates a plot showing the efficiency of heat transfer for the coalescence of different numbers of droplets.

FIG. 10 illustrates a plot showing the efficiency of heat transfer for the coalescence of different numbers of droplets 25. The results shown in FIG. 10 were obtained using a numerical simulation.

The x axis represents the Ohnesogre number. The left hand y axis represents the velocity of the combined larger droplet 27 divided by a scaling factor. The scaling factor could be the Weber number. The first trace 101 shows the plot for a cluster 31 comprising two nucleation sites 5 which leads to two individual droplets 25 coalescing to form a single larger droplet 27. The second trace 103 shows the plot for a cluster 31 comprising five nucleation sites 5 which leads to five individual droplets 5 coalescing to form a single larger droplet 27.

The right hand y axis represents the ratio of jumping velocities for coalesced droplets 27 formed from different numbers of individual droplets 25. In this example the different numbers of individual droplets 25 are five and two. The third trace 105 is plotted against this axis. The third trace 105 shows the ratio of the first trace 101 and the second trace 103 and shows that the velocity of the coalesced droplets 27 increases as the number of individual droplets 25 forming the coalesced droplets 27 increases from two to five.

FIG. 10 shows that the energy transfer from surface energy to kinetic energy is more efficient as the number of nucleation sites 5 within a cluster 31 is increased. Therefore increasing the number of nucleation sites 5 in cluster 31 from two to five enables more kinetic energy to obtained from smaller droplet sizes.

Figure 11:
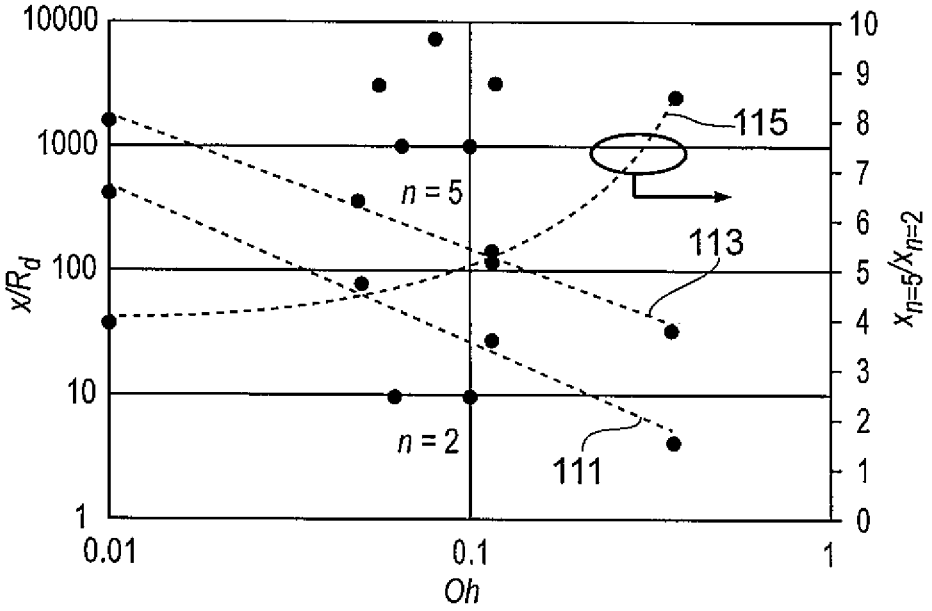
FIG. 11 illustrates a plot showing the efficiency of heat transfer for the coalescence of different numbers of droplets.

FIG. 11 illustrates a plot showing the efficiency of heat transfer for the coalescence of different numbers of droplets. The results shown in FIG. 11 were obtained using a numerical simulation.

In FIG. 11 the x axis represents the Ohnesorge number. The left hand y axis represents the ratio of the distance that the coalesced droplets 27 can jump divided by the radius of the coalesced droplets 27. This is shown on a logarithmic scale. In order to enable the coalesced droplets 27 to be removed from the surface 9 of the substrate 3 the coalesced droplets 27 must jump further than the radius of the coalesced droplet 27.

The first trace 111 in FIG. 11 shows the plot for a cluster 31 comprising two nucleation sites 5 which leads to two individual droplets 25 coalescing to form a single larger droplet 27. The second trace 113 shows the plot for a cluster 31 comprising five nucleation sites 5 which leads to five individual droplets 25 coalescing to form a single larger droplet 27.

The right hand y axis represents the ratio of distance traveled for coalesced droplets 27 formed from different numbers of individual droplets 25. In this example the different numbers of individual droplets 25 are five and two. The third trace 115 is plotted against this axis.

FIG. 11 shows that having more individual droplets 25 combine to make a single larger droplet 27 may enable the coalesced droplet 27 to jump further from the surface 9 of the substrate 3. This make it easier for the coalesced droplets 27 to be removed from the surface of the substrate 3.

Figure 12:
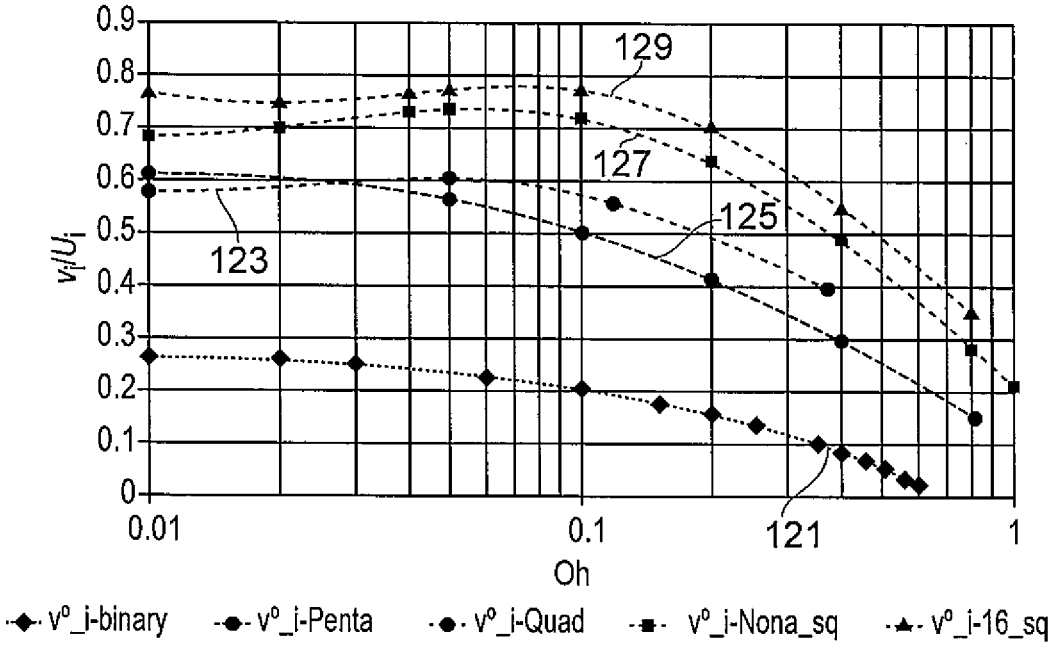
FIG. 12 illustrates a plot showing the efficiency of heat transfer for the coalescence of different numbers of droplets in different geometric arrangements.

FIG. 12 illustrates a plot showing the efficiency of heat transfer for the coalescence of different numbers of droplets in different geometric arrangements. The results shown in FIG. 12 were obtained using a numerical simulation.

The x axis represents the Ohnesogre number. The y axis represents the velocity of the coalesced droplet 27 divided by a scaling factor. The scaling factor could be the Weber number. The first trace 121 shows the plot for a cluster 31 comprising two nucleation sites 5 which leads to two individual droplets 25 coalescing to form a single larger droplet 27. The second trace 123 shows the plot for a cluster 31 comprising five nucleation sites 5 which leads to five individual droplets 5 coalescing to form a single larger droplet 27. The third trace 125 shows the plot for a cluster 31 comprising four nucleation sites. This leads to four individual droplets 5 coalescing to form a single larger droplet 27. The fourth trace 127 shows the plot for a cluster 31 comprising nine nucleation sites 5, This leads to nine individual droplets 5 coalescing to form a single larger droplet 27. The sixth trace 129 shows the plot for a cluster 21 comprising sixteen nucleation sites 5. This leads to sixteen individual droplets 5 coalescing to form a single larger droplet 27. The nine nucleation sites 5 were arranged in a three by three linear array and the sixteen nucleation sites 5 were arranged in a four by four linear array. Other arrangements for the nucleation sites 5 could be used in other examples of the disclosure.

FIG. 12 shows that the energy transfer is more efficient as the number of nucleation sites 5 within a cluster 31 is increased. Therefore increasing the number of nucleation sites 6 in a cluster 31 enables more energy to obtained from smaller droplet sizes.

Examples of the disclosure therefore provide for an apparatus 1 with increased efficiency of surface energy conversion during the coalescence induced droplet jumping. This increase in efficiency results in an increase in the kinetic energy of the jumping droplet 27 which enables the coalesced droplet 27 to escape the boundary layer of the surface 9 of the substrate 3. The increase in efficiency therefore enables more droplets 27 to be removed from the substrate 3 which reduces the average size of droplets 25 remaining on the surface 9 of the substrate 3 and so increases the efficiency of the heat transfer between a vapour and the apparatus 1.

Examples of the disclosure also enable the droplet jumping to be induced for smaller droplets due to the increased efficiency of the conversion between surface energy and kinetic energy. In examples of the disclosure the droplet jumping may be induced for nano-sized coalesced droplets 27. That is, the droplet jumping may be induced for coalesced droplets 27 having a size of less than one micron. In some examples the jumping could be induced for coalesced droplets 27 having a size of just a few nanometers. Decreasing the size for which the droplet jumping occurs enables more individual droplets 25 to coalesce and allows them to coalesce faster. This therefore provides more efficient heat transfer.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a substrate;

a plurality of nucleation sites provided on the substrate, the plurality of nucleation sites being arranged in clusters, wherein spacing between nucleation sites in a given cluster is less than spacing between the nucleation sites in the given cluster to nucleation sites in other clusters;

a nanostructured surface surrounding the nucleation sites arranged to enable coalescence induced droplet jumping, wherein both the plurality of nucleation sites and the nanostructured surface are hydrophobic, whereby droplets condensed on the nucleation sites in a given cluster coalesce and jump from the substrate.

2. The apparatus as claimed in claim 1, wherein the nanostructured surface is arranged so that the spacing between nucleation sites enables coalescence induced droplet jumping.

3. The apparatus as claimed in claim 1, wherein the plurality of nucleation sites is arranged in clusters such that each nucleation site within a cluster is equally spaced from a central point of the cluster.

4. The apparatus as claimed in claim 1, wherein the plurality of nucleation sites is arranged in clusters comprising a plurality of sub-groups wherein each sub-group comprises a plurality of nucleation sites located on the circumference of a circle and the circles corresponding to the different sub-groups are concentric.

5. The apparatus as claimed in claim 3, wherein the ratio of the distance from the centre of a nucleation site to a centre of the cluster and the diameter of the nucleation sites is between two and three.

6. The apparatus as claimed in claim 3, wherein each cluster of nucleation sites comprises more than two nucleation sites.

7. The apparatus as claimed in claim 3, wherein the plurality of nucleation sites within a cluster is arranged in a symmetrical pattern.

8. The apparatus as claimed in claim 3, wherein the plurality of nucleation sites within a cluster is arranged in a hexagon.

9. The apparatus as claimed in claim 1, further comprising a hydrophobic coating provided on both the plurality of nucleation sites and the nanostructured surface.

10. The apparatus as claimed in claim 9, wherein the hydrophobic coating comprises a polymer.

11. The apparatus as claimed in claim 1, wherein the nanostructured surface comprises nanostructures arranged to extend perpendicularly from the substrate.

12. The apparatus as claimed in claim 1, wherein the nanostructured surface comprises nanostructures having a high aspect ratio.

13. The apparatus as claimed in claim 1, wherein surfaces of the nucleation sites are smooth.

14. The apparatus as claimed in claim 1, wherein the nucleation sites have a higher surface energy than the nanostructured surface.

15. The apparatus as claimed in claim 1, wherein the nucleation sites have a higher thermal conductivity than the nanostructured surface.

16. The apparatus as claimed in claim 1, wherein the nucleation sites and the nanostructured surface are formed from the same material.

17. The apparatus as claimed in claim 1, wherein each nucleation site has a diameter in a range from 1 to 100 nanometers.

18. A heat transfer system comprising the apparatus as claimed in claim 1.

19. The heat transfer system as claimed in claim 18, wherein the apparatus provides a condenser.

20. The heat transfer system as claimed in claim 18, wherein the apparatus provides an evaporator.

* * * * *